US008348270B2

(12) United States Patent
Nishikata et al.

(10) Patent No.: US 8,348,270 B2
(45) Date of Patent: Jan. 8, 2013

(54) IMAGE FORMING APPARATUS

(75) Inventors: Kazushi Nishikata, Odawara (JP); Yoji Misao, Susono (JP); Satoshi Koga, Numazu (JP); Kazunari Nishimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/162,484

(22) Filed: Jun. 16, 2011

(65) Prior Publication Data

US 2012/0001386 A1 Jan. 5, 2012

(30) Foreign Application Priority Data

Jun. 30, 2010 (JP) ..... 2010-150247

(51) Int. Cl.
*B65H 7/02* (2006.01)

(52) U.S. Cl. ..... 271/265.03; 271/227

(58) Field of Classification Search ..... 271/265.01, 271/265.02, 265.03, 227, 186, 161; 399/364
See application file for complete search history.

(56) References Cited

U.S. PATENT DOCUMENTS

| | | | | |
|---|---|---|---|---|
| 6,032,949 | A * | 3/2000 | Ando | 271/225 |
| 7,883,087 | B2 * | 2/2011 | Kitano | 271/258.01 |
| 8,177,228 | B2 * | 5/2012 | Nutzel et al. | 271/262 |
| 2009/0102118 | A1 * | 4/2009 | Shibano | 271/265.03 |

FOREIGN PATENT DOCUMENTS

JP 2002-053246 A 2/2002

* cited by examiner

*Primary Examiner* — Patrick Cicchino
(74) *Attorney, Agent, or Firm* — Canon USA, Inc., IP Division

(57) ABSTRACT

An image forming apparatus includes a main body, a sheet conveyance apparatus, and a control unit. The main body includes an image forming unit to form an image on a sheet. The sheet conveyance apparatus and the main body are detachable from each other and the sheet conveyance apparatus may convey the sheet to the image forming unit. The sheet conveyance apparatus includes a sheet conveyance path through which the sheet passes and a detection unit. The detection unit includes light emitting and receiving units that transmit light across the sheet conveyance path therebetween. The detection unit detects a reference and an edge position of the conveyed sheet in a width direction of the sheet orthogonal to a sheet conveyance direction. The control unit determines a position of the sheet based on detections of the reference and the edge position of the conveyed sheet by the detection unit.

9 Claims, 14 Drawing Sheets

IMAGE FORMING APPARATUS

BACKGROUND OF THE INVENTION

1. Field of the Invention

The present invention relates to an image forming apparatus.

2. Description of the Related Art

In a conventional image forming apparatus such as a copying machine or a printer, a sheet whose one side has undergone image formation in an image forming unit is reversed, and conveyed again to the image forming unit via a reverse conveyance unit to perform image formation on the reverse side (two-sided printing). In such an image forming apparatus, there is a fear, at the time of two-sided printing, of the image formed on the sheet being deviated in the width direction, which is a direction orthogonal to the sheet conveyance direction.

This is due to the fact that, in the case of two-sided printing, the sheet conveyance path to be taken from the sheet feeding before the image formation on the second surface of the sheet is longer as compared with the case of one-sided printing. When the sheet conveyance path is thus long, the influence of minute misalignment of the conveyance rollers, distortion of the guide plate, etc. is added, sometimes resulting in gradual deviation of the sheet in the conveyance width direction.

In view of this, in the prior art, there is provided in the sheet conveyance path a detection sensor configured to detect a side edge position in the width direction of the sheet to detect the deviation amount in the width direction of the sheet. And, according to the deviation amount of the side edge position of the sheet thus detected by the detection sensor, the position of the latent image to be written to the photosensitive drum in the image forming unit is shifted, whereby the sheet is matched with the image forming position.

On the other hand, in recent image forming apparatuses, there is a demand for a further improvement in terms of user operability, in particular, of jamming handling property. In view of this, in more and more image forming apparatuses, the sheet conveyance apparatus is made detachable with respect to the image forming apparatus main body, and, when jamming has occurred, the sheet conveyance apparatus is drawn out to the front face, the rear face, or a side face of the apparatus main body, whereby the conveyance path is exposed to the exterior, thereby facilitating the jamming handling processing.

In such a detachable sheet conveyance apparatus, a detection sensor is arranged in the sheet conveyance path in the apparatus, and the position of a side edge position of the sheet is detected by this detection sensor. However, when the sheet conveyance apparatus is attached to the image forming apparatus main body, due to play between itself and the image forming apparatus main body and variation in component dimension, the sheet conveyance apparatus may be deviated in the sheet conveyance direction. In such cases, the detection sensor is also deviated with respect to the image forming apparatus main body, resulting in positional deviation between the detection sensor and the image forming unit.

In view of this, in a conventional image forming apparatus, the detection sensor is provided to be movable in the width direction; when detecting a sheet side edge position after the attachment of the sheet conveyance apparatus, the detection sensor is first moved toward the image forming apparatus main body to detect the position of a reference member provided in the image forming apparatus main body. And, after the position of the reference member is thus detected, the detection sensor is moved toward the sheet, whereby the sheet side edge position is detected (See Japanese Patent Application Laid-Open No. 2002-53246). Based on the movement amount of the detection sensor since the detection of the position of the reference member on the image forming apparatus main body side till the detection of the sheet side edge position, it is possible to obtain the actual sheet side edge position, in another words, the deviation amount of the sheet side edge position from the reference position. And, by adjusting the image writing position according to the deviation amount thus obtained, it is possible to correct the image forming position on the sheet.

As described above, in the conventional sheet conveyance apparatus and image forming apparatus as discussed in Japanese Patent Application Laid-Open No. 2002-53246, when detecting a sheet side edge position, the detection unit is first moved toward the reference member to detect the reference member. After this, to detect the side edge of the sheet, the detection unit is moved in the width direction of the sheet. However, when moving the sheet side end for detection after the movement of the detection unit toward the reference member to detect the reference member, it is necessary to secure a long movement distance for the detection unit for a case in which the sheet whose side edge position is to be detected is a sheet of a small width size. This involves a large-sized movement mechanism for moving the detection unit, resulting in an increase in the size of the apparatus.

SUMMARY OF THE INVENTION

The present invention is directed to an image forming apparatus of a small size and capable of detecting a sheet side edge position. Further, the present invention is directed to an apparatus of small in size and high accuracy capable of detecting a sheet side edge position.

According to an aspect of the present invention, an image forming apparatus includes: an image forming apparatus main body having an image forming unit configured to form an image on a sheet; and a sheet conveyance apparatus provided to be detachable with respect to the image forming apparatus main body and configured to convey the sheet to the image forming unit, wherein the sheet conveyance apparatus includes a sheet conveyance path through which the sheet passes, and a detection unit including a light emitting unit and a light receiving unit, opposed to the light emitting unit across the sheet conveyance path therebetween, configured to receive light from the light emitting unit, wherein the detection unit is configured to detect a reference and to detect an edge position of the conveyed sheet in a width direction of the sheet orthogonal to the sheet conveyance direction, the image forming apparatus further comprising a control unit configured to determine a position of the sheet based on detections of the reference and the edge position of the conveyed sheet by the detection unit, and wherein the light receiving unit of the detection unit is composed of a plurality of light receiving elements configured to receive light from the light emitting unit and arranged in the width direction on a same substrate.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
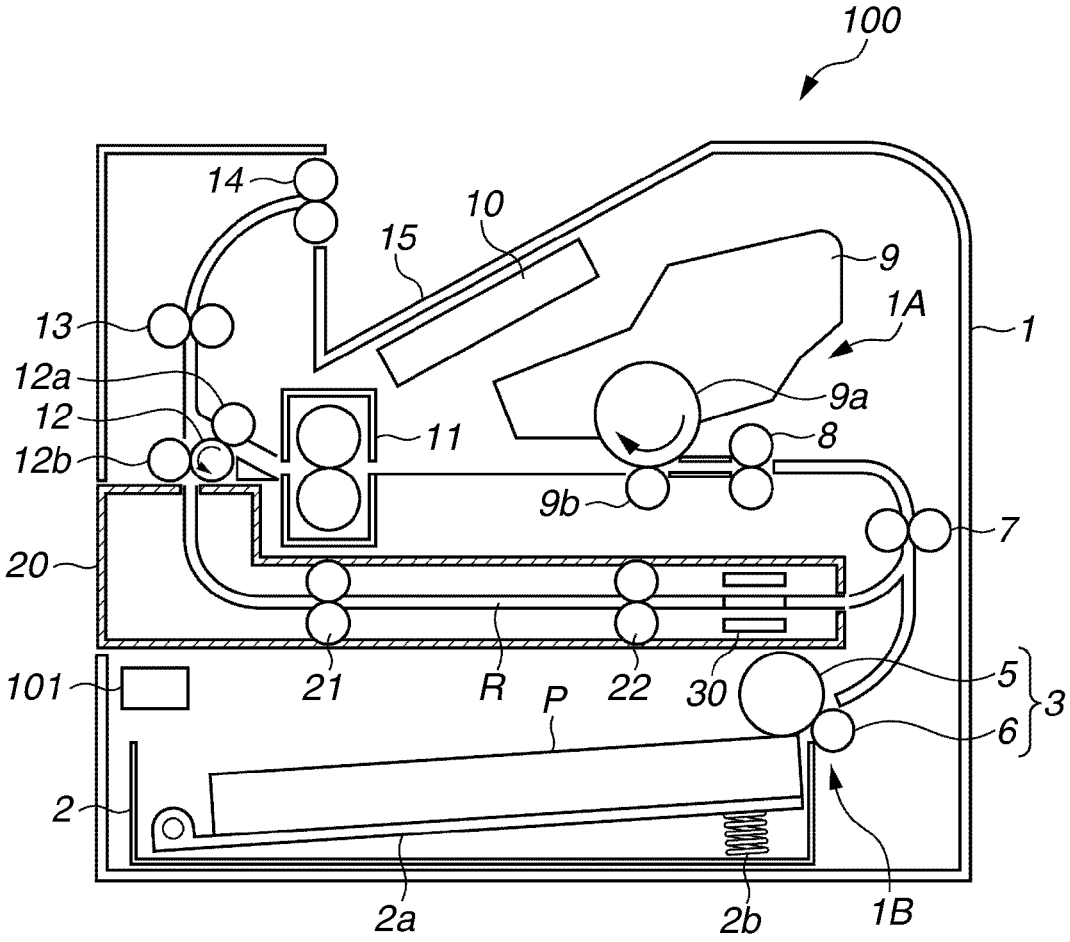
FIG. 1 is a diagram schematically illustrating the general construction of an image forming apparatus equipped with a sheet conveyance apparatus according to a first exemplary embodiment of the present invention.

FIG. 1 is a diagram illustrating the general construction of an image forming apparatus equipped with a sheet conveyance apparatus according to the first exemplary embodiment of the present invention. In FIG. 1, numeral 100 denotes an image forming apparatus, and numeral 1 denotes an image forming apparatus main body (hereinafter referred to as the apparatus main body). The apparatus main body 1 is equipped with an image forming unit 1A having a photosensitive drum 9*a*, etc.; in the lower portion of the apparatus main body 1, there is provided a sheet feeding apparatus 1B configured to feed sheets P such as recording paper sheets stacked in a sheet feeding cassette 2 to an image forming unit 1A.

Further, the apparatus main body 1 is equipped with a transfer roller 9*b*, which abuts on the photosensitive drum 9*a* and forms a transfer unit together with the photosensitive drum 9*a*, and a fixing device 11 configured to fix a toner image transferred by the transfer unit to the sheet P. Further, between the image forming unit 1A and the sheet feeding cassette 2, there is arranged to be detachable to the apparatus main body 1 a two-sided unit 20, which is a sheet conveyance apparatus configured to reverse and convey a sheet whose first side has undergone image formation and having a reverse conveyance path R that is a sheet conveyance path for conveying the sheet to the image forming unit 1A again.

The image forming unit 1A is equipped with a process cartridge 9 having the photosensitive drum 9*a*, a charger (not illustrated), a development sleeve, a cleaning unit, etc. Further, there is provided a laser scanner 10 which is an exposure unit configured to cause the surface of the photosensitive drum 9*a* to be exposed and to form an electrostatic latent image on the photosensitive drum 9*a*.

The sheet feeding apparatus 1B is equipped with a pickup roller 5, which is a feeding member configured to feed out the sheets P stacked in the sheet feeding cassette 2 starting from the uppermost one. Further, the sheet feeding apparatus 1B is equipped with a separation roller 6 which is held in press contact with the pickup roller 5 and configured to separate and convey one by one, together with the pickup roller 5, the sheets P fed out by the pickup roller 5. The sheet feeding cassette 2 is provided with a sheet stacking plate 2*a*, and a pressurization spring pressurizing the lower surface of the sheet stacking plate 2*a* upwardly; owing to the pressurization spring 2*b*, the uppermost sheet P on the sheet stacking plate 2*a* is held in press contact with the pickup roller 5. In FIG. 1, numeral 101 denotes a control unit. The control unit 101 controls the image forming operation of the apparatus main body 1, and, as described below, based on a positional deviation amount in the width direction of the sheet, adjusts the writing position in the main scanning direction on the photosensitive drum, thereby adjusting the position of the image formed on the sheet.

Next, the image forming operation of the image forming apparatus 100, constructed as described above, will be illustrated. When the image forming operation is started, the photosensitive drum 9*a* first rotates in the direction of the arrow, with its surface being charged by a charger (not illustrated); after this, a laser beam is emitted to the photosensitive drum 9*a* from the laser scanner 10 based on image information. As a result, an electrostatic latent image is formed on the photosensitive drum. Next, as a development sleeve (not illustrated) rotates, toner, which is charged to an appropriate degree, is supplied onto the photosensitive drum 9*a*, whereby the electrostatic latent image is developed to be visualized as a toner image.

In the meantime, in parallel with this toner image forming operation, the pickup roller 5 is driven by a driving motor (not illustrated) and is rotated, thereby feeding out the uppermost sheet P in the sheet feeding cassette 2. And, the sheet P thus fed out by the pickup roller 5 is conveyed while separated by a separation unit 3, which is configured with the pickup roller 5 and the separation roller 5, and is conveyed to a registration roller pair 8 at rest via a conveyance roller pair 7. After this, leading edge alignment (skew feed correction) is performed by the registration roller pair 8.

Next, in the image forming unit 1A, the sheet P is conveyed to the transfer unit by the registration roller pair 8 in conjunction with the image formed on the photosensitive drum 9*a*, and the image on the photosensitive drum 9*a* is transferred to the sheet P by the transfer roller 9*b*. After this, the sheet P, to which the toner image has been transferred, is conveyed to the fixing device 11, where the unfixed toner image is fixed to the sheet surface through heating/pressurization.

On the downstream side of the fixing device 11, there are provided a triple driving roller 12 configured to rotate counterclockwise, and a triple driven roller A 12*a* and triple driven roller B 12*b*, which are held in press contact with the triple driving roller 12. And, as the tripe driving roller 12 rotates, the triple driven roller A 12*a* and the triple driven roller B 12*b* rotate clockwise. Owing to this construction, in the case of one-sided printing, the sheet P, to which the toner image has been fixed, is conveyed via a conveyance roller pair 13 and a discharge roller pair 14 by the triple driving roller 12 and the tripe driven roller A 12*a*, and is successively stacked on a discharge tray 15 on the upper surface of the apparatus main body, with the printed surface down.

On the other hand, in the case where image formation is performed on both sides of the sheet P, after the trailing edge of the sheet whose first surface has undergone image formation has passed the triple driving roller 12 and the tripe driven roller A 12*a*, a driving motor (not illustrated) is reversed to cause reverse rotation of the conveyance roller pair 13 and the discharge roller pair 14. As a result, the sheet P whose one surface has undergone image formation is conveyed, starting with the trailing edge as a leading edge, toward the nip portion between triple driving roller 12 and triple driven roller B 12*b*.

At this time, the triple driving roller 12 continues to rotate counterclockwise, so that the sheet P, which has been conveyed to the nip portion between the triple driving roller 12 and the triple driven roller B 12*b*, is conveyed toward a two-sided unit 20. And, the reversed sheet P is conveyed to a conveyance roller pair 7 in the apparatus main body via conveyance roller pairs 21 and 22 provided in the two-sided unit. After this, the sheet P is conveyed to the transfer unit again via a registration roller pair 8, with the first printed surface down, then the toner image is transferred to the second surface. As in the case of one-sided printing, the sheet to whose both sides toner images have been transferred is conveyed via the fixing device 11, the conveyance roller pair 13, and the discharge roller pair 14 and is successively stacked on the discharge tray 15.

Figure 2:
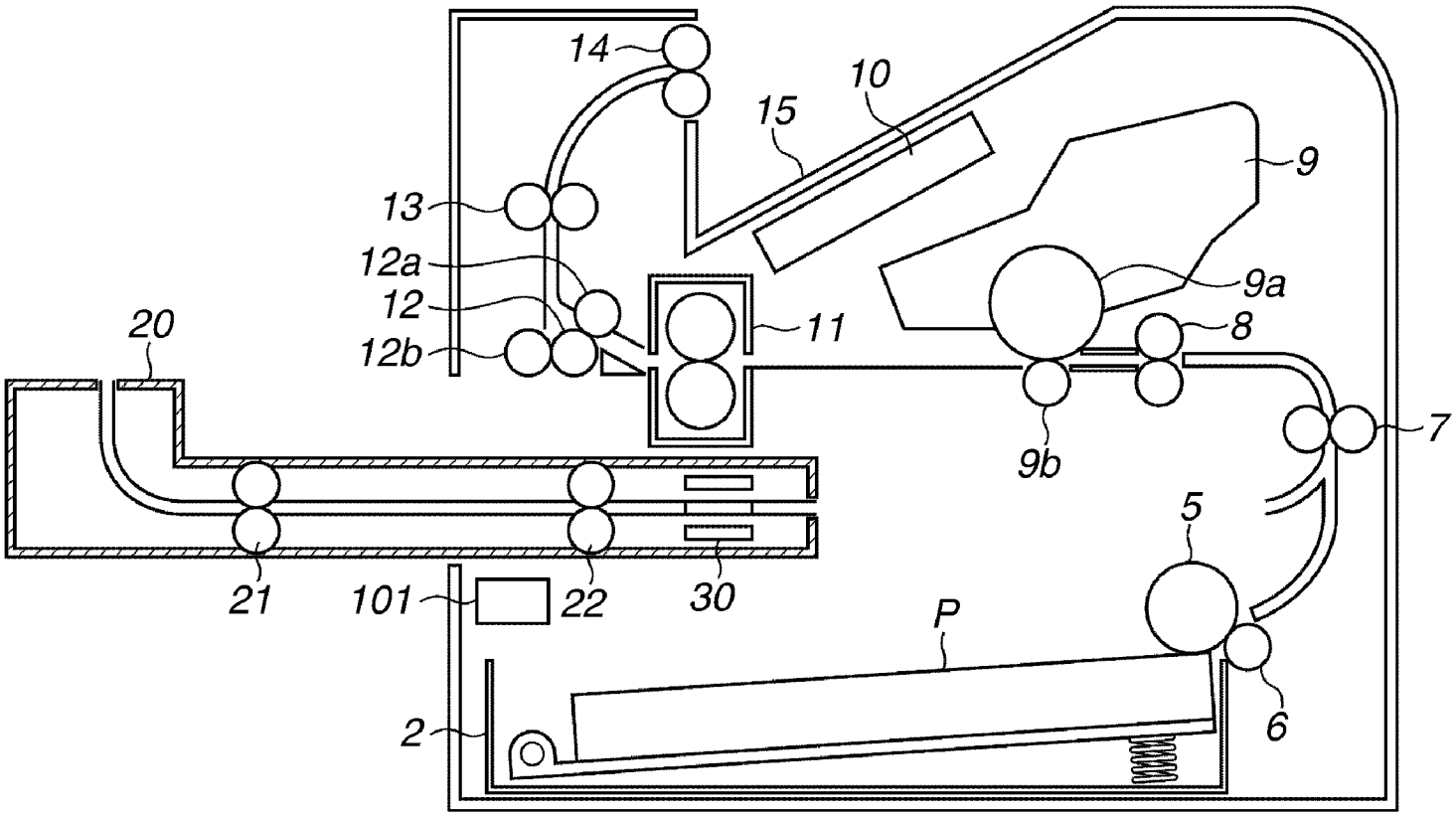
FIG. 2 illustrates a two-sided unit, which constitutes the sheet conveyance apparatus, as drawn out of the image forming apparatus main body.

As described above, the two-sided unit 20 is detachably attached to the apparatus main body 1. And, when jamming occurs in the apparatus main body, the two-side unit 20 is drawn out of the apparatus main body 1 as illustrated in FIG. 2, whereby access to the interior of the reverse conveyance path R and to the interior of the apparatus main body becomes available.

Further, on the downstream side in the sheet conveyance direction of the conveyance roller 22, the two-sided unit 20 has a side edge detection sensor unit 30 configured to detect one side edge position in the width direction, which is orthogonal to the conveyance direction of the sheet P passing through the reverse conveyance path R. And, in the case of two-sided printing, the sheet having passed through the reverse conveyance path R is conveyed, with a side edge position thereof being detected by the side edge detection sensor unit 30. To make the influence of skew feed during sheet conveyance up to the image forming unit 1A as small as possible, the side edge detection sensor unit 30 can be arranged at a position as close as possible to the image forming unit 1A.

Figure 3A:
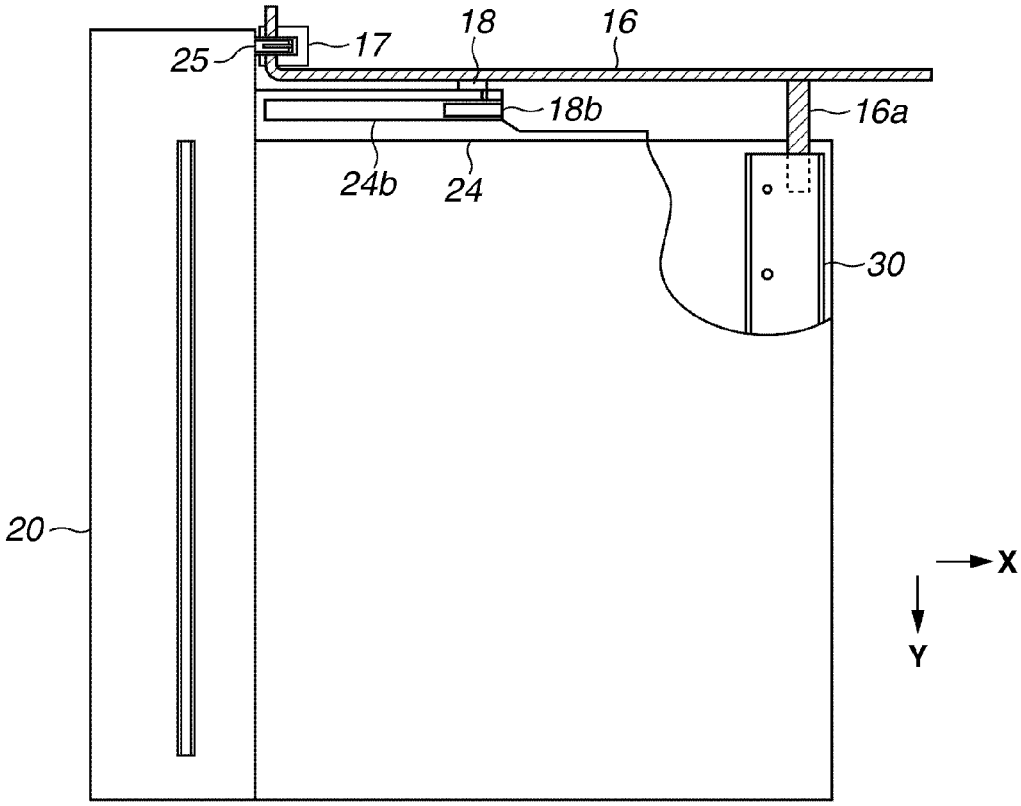
FIGS. 3A and 3B illustrate the construction of the two-sided unit.
Figure 3B:
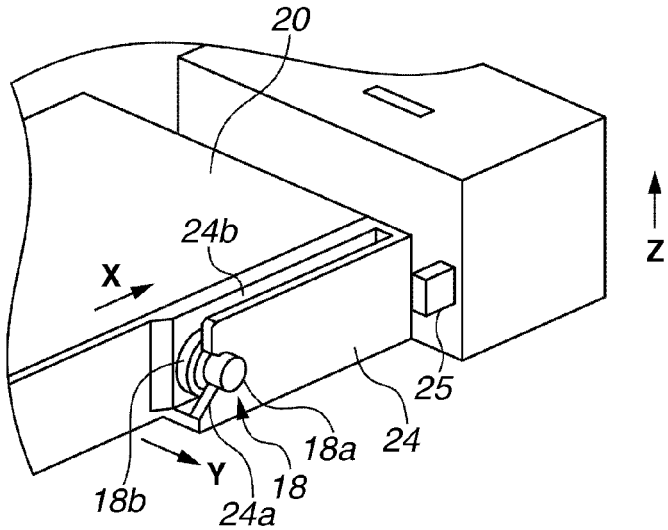

When attaching the two-sided unit 20 to the apparatus main body 1, as illustrated in FIGS. 3A and 3B, the two-sided unit 20 is equipped with a positioning member 24, which is engaged with a positioning pin 18 provided on a rear side plate 16 on the depth side of the apparatus main body, and a connector 25. And, when attaching the two-side unit 20 to the apparatus main body 1, the positioning member 24 is engaged with the positioning pin 18 on the rear side plate 16, whereby positioning is effected on the two-sided unit 20 with respect to the apparatus main body 1.

Here, assuming that the sheet conveyance direction is the X-direction, that the width direction is the Y-direction, and that the apparatus height direction is the Z-direction, a Y-direction positioning portion 18*b* of the positioning pin 18 and a Y-direction positioning surface 24*b* of the positioning member 24 perform poisoning in the width direction on the two-sided unit 20. Further, an XZ-direction positioning shaft portion 18*a* of the positioning pin 18 and an XZ-direction positioning hole portion 24*a* perform positioning on the two-side unit 20 in the sheet conveyance direction and the apparatus height direction. Further, in the state in which positioning has been effected on the two-sided unit 20, the connector 25 provided on the two-sided unit 20 illustrated in FIG. 3B is connected to a connector 17 provided in the apparatus main body 1 illustrated in FIG. 3A, whereby electrical and controlling communication with the apparatus main body 1 is enabled.

In FIGS. 3A and 3B, numeral 16*a* denotes a reference plate constituting a reference portion for detecting a sheet side edge position described below and detecting positional deviation of the two-sided unit 20 with respect to the apparatus main body 1; the reference plate 16*a* is provided on the rear side plate 16. And, when the two-sided unit 20 is attached to the apparatus main body 1, the forward end portion of the reference plate 16*a* enters the interior of a side edge detection sensor unit 30.

Figure 4A:
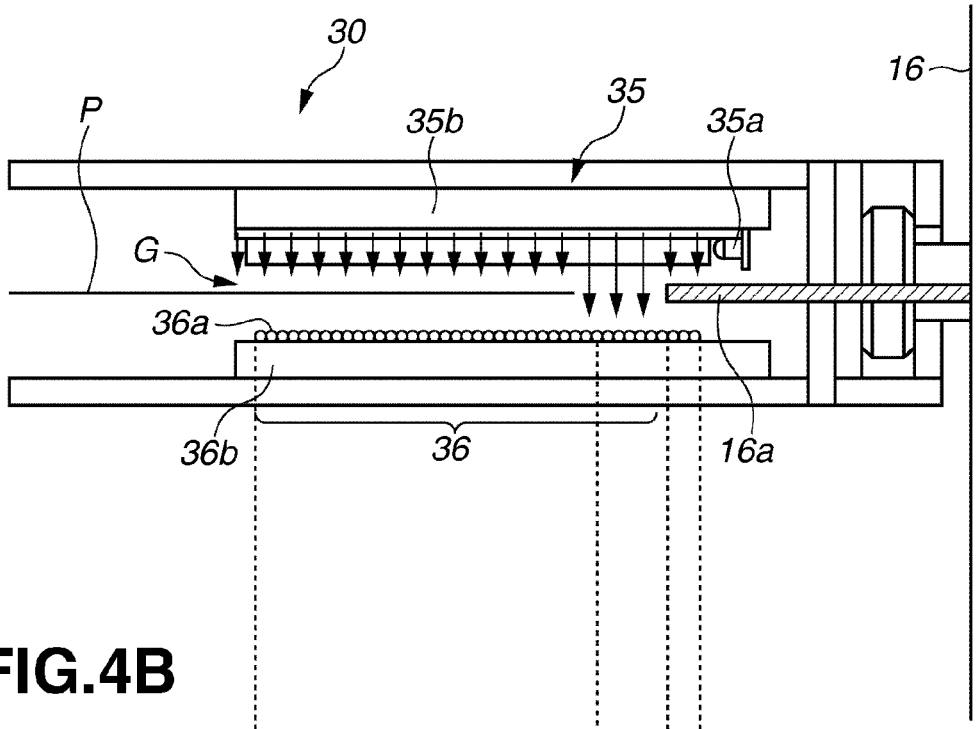
FIGS. 4A and 4B illustrate a sheet side edge detecting operation by a side edge detection sensor unit provided in the two-sided unit.

As illustrated in FIG. 4A, the side edge detection sensor unit 30 is provided with a light emitting unit 35 equipped with an LED 35*a* provided above and serving as a light emission source and a light guide 35*b* configured to diffuse the light from the LED 35*a* downwardly.

Further, below, there is provided a light receiving unit 36 having a substrate 36*b* on which there are arranged in series a plurality of light receiving elements 36*a* and arranged to face the sheet passing the reference plate 16*a* and the reverse conveyance path R. And, between the light emitting unit 35 and the light receiving unit 36, there exists a space G through which one side edge portion in the width direction of the sheet P passes and which the forward end of the reference plate 16*a* provided on the rear side plate 16 enters. The length of the light emitting unit 35 and the light receiving unit 36 in the width direction is large enough to cover the side edge of a sheet of a minimum size to the side edge of a sheet of a maximum size conveyable and the forward end portion of the reference plate 16*a* that has entered the space G.

Figure 4B:
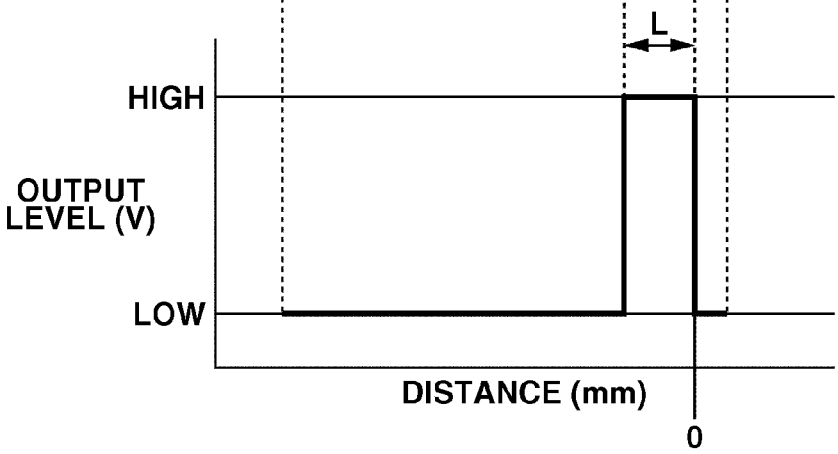

Next, a sheet side edge position detecting operation by the side edge detection sensor unit 30, which is a detection unit for simultaneously detecting the reference plate 16*a* and the side edge position in the width direction of the sheet, will be described. As illustrated in FIG. 4A, when the sheet P is conveyed into the two-sided unit 20, the output signal of a light receiving element 36*a* is as illustrated in FIG. 4B. Specifically, when light from the light emitting unit 35 passes through, the light receiving element 36*a* outputs a High output signal, and, when shielded by the sheet constituting an obstruction or the reference plate 16*a*, it outputs a Low output signal.

Thus, as illustrated in FIG. 4B, in the range in which the light receiving element 36*a* is covered with the sheet P and the reference plate 16*a*, the Low output signal is output, and solely in the range L in which there is no obstruction, the High output signal is output. Here, based on the output signals as illustrated in FIG. 4B, a control unit 101 (not illustrated) recognizes the right-hand side trailing edge from High to Low as a 0-reference, calculating the distance L of the High signal indicating the light receiving state as the sheet side edge position. And, based on this calculation result, the image writing position is corrected by an image writing control unit (not illustrated), and an image rendered proper is formed on the sheet having passed the side edge detection sensor unit 30.

In this way, in the present exemplary embodiment, the sheet side edge position and the reference position (the reference plate 16*a*) of the apparatus main body 1 are simultaneously read by the plurality of light receiving elements 36*a* mounted on the same substrate 36*b*. And, owing to this construction, it is possible to detect the sheet side edge position in a short time. Specifically, in the present exemplary embodiment, the light receiving unit 36 of the side edge detection sensor unit 30 is configured with the plurality of light receiving elements 36*a* arranged in series on the same substrate 36*b*, whereby it is possible to detect the sheet side edge position in a short time.

Further, the light receiving elements 36*a* read the reference position (the reference plate 16*a*), whereby it is possible to cancel positional deviation due to play between the units of the apparatus main body 1 and variation in component dimension. As a result, it is possible to detect the sheet side edge position without being affected by positional deviation between the apparatus main body 1 and the unit. Thus, by controlling the unit dimension of the plurality of light receiving elements 36*a*, it is possible to detect the sheet side edge position with high precision, and the image forming position on the sheet can be optimized.

Figure 5:
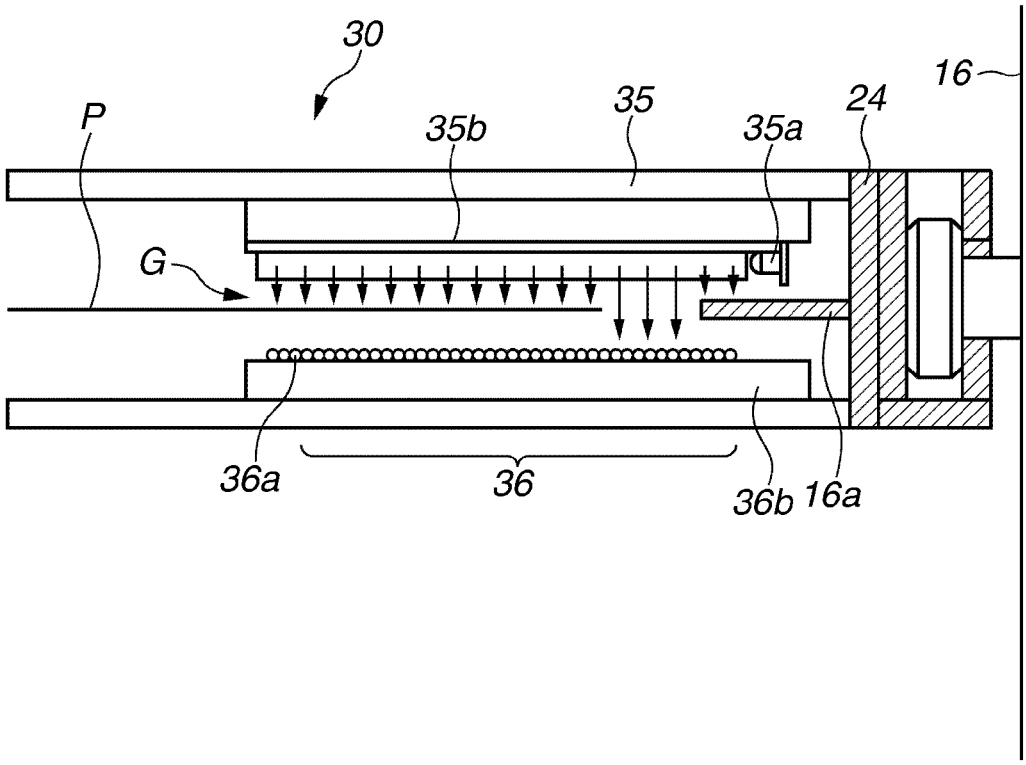
FIG. 5 illustrates another construction of the side edge detection unit.

FIG. 5 is a sectional view illustrating another construction of the present exemplary embodiment, in which the reference plate 16*a* is provided on the positioning member 24 provided on the two-sided unit 20. Owing to this construction, it is possible to absorb play between the apparatus main body 1 and the unit, whereby the sheet side edge position can be detected with high precision.

Figure 6:
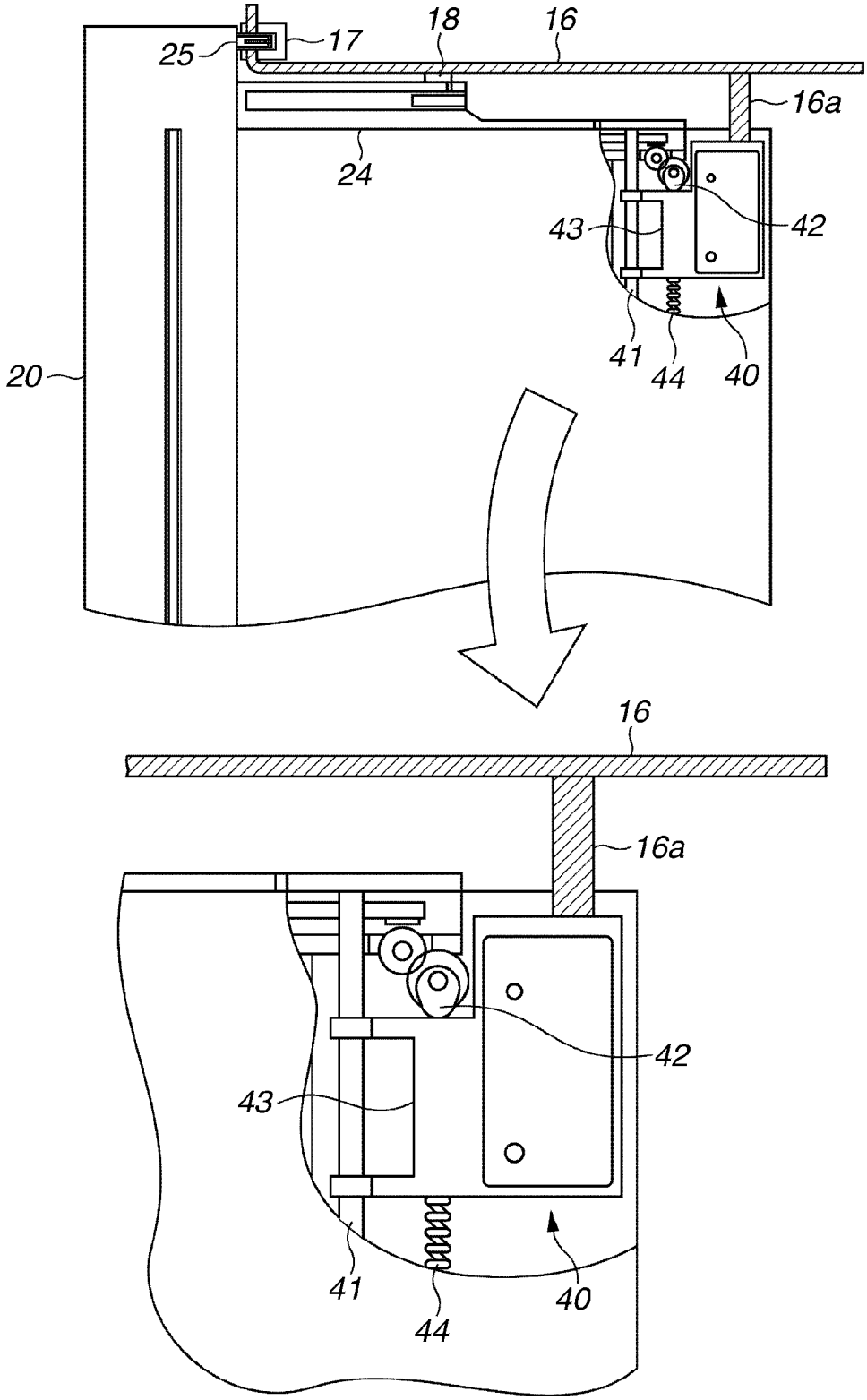
FIG. 6 illustrates the construction of a two-sided unit, which constitutes a sheet conveyance apparatus according to a second exemplary embodiment of the present invention.

Next, the second exemplary embodiment of the present invention will be described. FIG. 6 is a diagram illustrating the construction of a two-sided unit constituting a sheet conveyance apparatus according to the present exemplary embodiment. In FIG. 6, the same reference numerals as those in FIGS. 3A and 3B denote the same or equivalent components.

In FIG. 6, numeral 40 denotes a side edge detection sensor unit; this side edge detection sensor unit 40 is capable of reciprocating in the width direction along a guide shaft 41. Numeral 43 denotes a sensor holder holding the side edge detection sensor unit; it is fit-engaged with the guide shaft 41 at two positions, and is supported to be slidable in width direction along the guide shaft 41. Numeral 42 denotes a cam held in contact with the sensor holder 43 and configured to cause the side edge detection sensor unit 40 to slide along the guide shaft 41 via the sensor holder 43.

The sensor holder 43 is constantly held in contact with the cam 42 by the biasing force of a spring 44. Owing to this construction, when the cam 42 receives a drive force from a gear row (not illustrated) and rotates, the sensor holder 43 performs sliding operation. The gear row (not illustrated) is connected with a driving gear row driving a conveyance roller pair 21, 22 of the two-side unit 20.

Figure 7A:
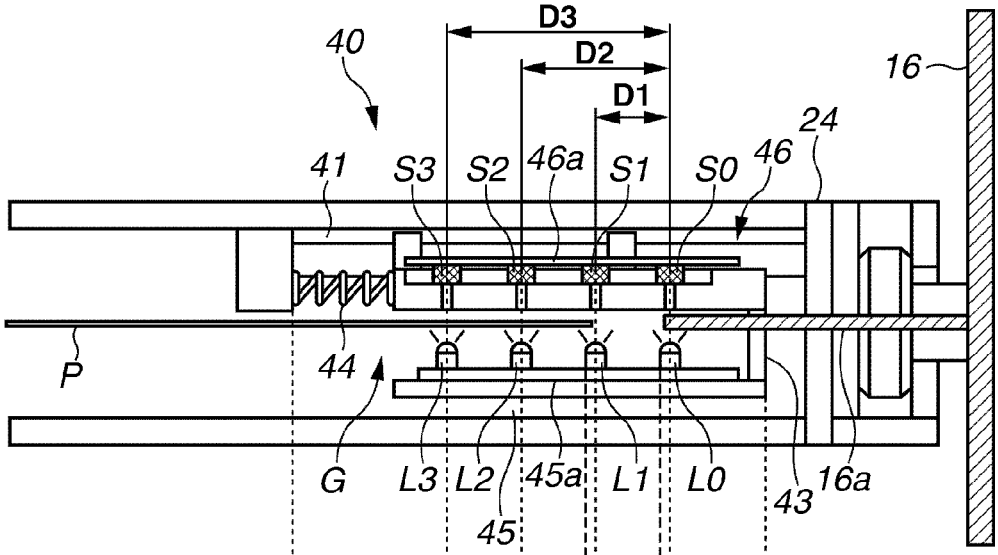
FIGS. 7A and 7B illustrate a side edge detecting operation of a side edge detection sensor unit provided in the two-sided unit.
Figure 7B:
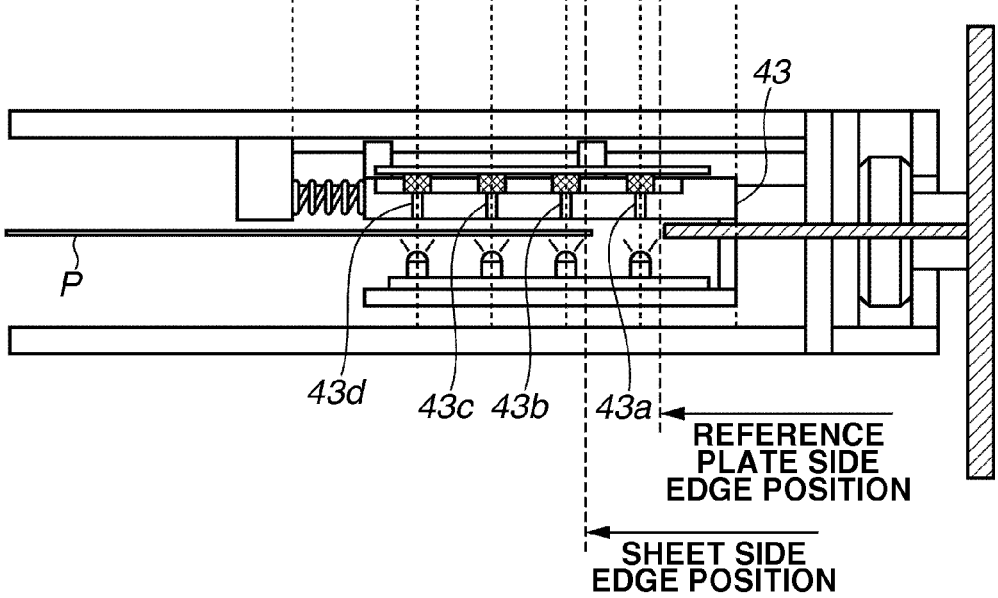

As illustrated in FIGS. 7A and 7B, in the upper portion of the sensor holder 43, there is provided a light receiving unit 46 having a substrate 46*a* on which four light receiving elements S0 through S3 are mounted so as to be respectively opposed to point light sources L0 through L3 above. In the lower portion of the sensor holder, there is provided a light emitting unit 45 having a substrate 45*a* on which the four point light sources (light-emitting diodes (LEDs)) L0 through L3 are mounted. The sensor holder 43 has aperture configurations under the respective four light receiving elements S0 through S3. Further, between the light receiving unit 46 and the light emitting unit 45, there is the space G through which one side edge portion in the width direction of the sheet P passes and which the forward end of the reference plate 16*a* provided on the rear side plate 16 enters.

As described above, as the cam 42 rotates, the sensor holder 43 makes a sliding motion, so that the light receiving unit 46 and the light emitting unit 45 make an integral sliding motion. In the present exemplary embodiment, the first light receiving element S0, which is nearest to the reference plate 16*a*, serves to detect the reference plate 16*a*, and the others, i.e., the second through fourth light receiving elements S1 through S3, serve to detect the side ends of sheets of different sizes. And, using the light receiving element S0 as a reference, the light receiving elements S1 through S3 are mounted on the substrate 46*a* at distances D1, D2, and D3 in conformity with the sheet sizes so that they can detect the side edge positions of sheets of different lengths in the width direction. While in the present exemplary embodiment the four light receiving elements S0 through S3 are arranged in line in the width direction on the substrate 46*a*, it is also possible to increase the number of light receiving elements according to the sheet sizes that can be dealt with by the apparatus. Here, the arrangement in the width direction signifies that the positions in the width direction of the four light receiving elements S0 through S3 differ from each other; it is also possible for the four light receiving elements S0 through S3 to be offset from each other in the conveyance direction.

In this way, in the side edge detection sensor unit 40, the point light sources L0 through L3 and the light receiving elements S0 through S3 are arranged in the sheet width direction corresponding to the different sheet sizes and configured to slide in width direction. Specifically, the pairs formed by the point light sources L0 through L3 and the light receiving elements S0 through S3 are set at positions corresponding to the different sheet sizes. The sliding distance of the side edge detection sensor unit 40 is approximately ±3 to ±6 mm with respect to designed value for sheet sizes. However, there are no particular limitations regarding the sliding distance if setting is made such that the sliding amount increases in correspondence with the addition of the tolerance of the sheet dimension, the skew feed amount, etc. However, the above-mentioned sliding amount helps to achieve a reduction in the size of the sliding mechanism. For example, it is possible to perform sliding operation using a cam, thus a reduction in the size of the sliding mechanism can be achieved.

Next, the sheet side edge position detecting operation by the side edge detection sensor unit 40 will be described. FIG. 7A illustrates a state in which, to detect the reference plate 16*a*, the sensor holder 43 has performed sliding operation to be shifted to the right, and FIG. 7B illustrates a state in which, to detect the sheet side edge position, the sensor holder 43 has performed sliding operation to be shifted to the left. And, as described above, the cam 42 is drive-connected with the conveyance roller of the two-sided unit, so that, while the sheet is conveyed by the two-sided unit 20, the side edge detection sensor unit 40 is repeatedly placed in the states of FIGS. 7A and 7B.

Figure 8:
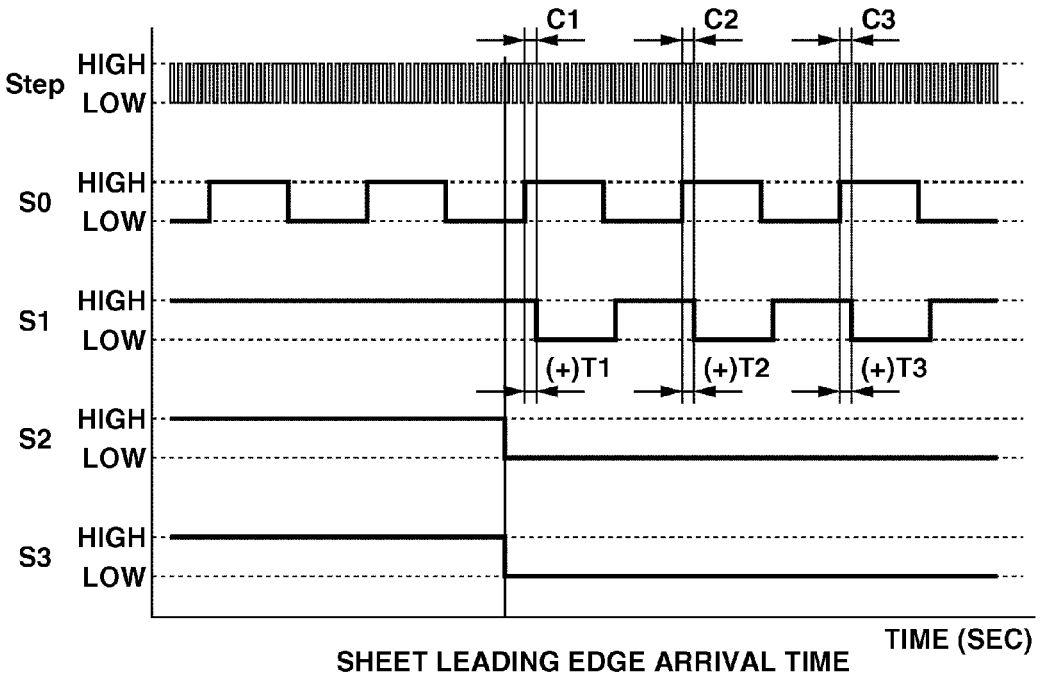
FIG. 8 is a chart illustrating output signals of the side edge detection sensor unit.

FIG. 8 illustrates the output signals of the light receiving elements S0 through S3; the horizontal axis indicates time, and the vertical axis indicates the output signals of the light receiving elements. At the top of FIG. 8, there is indicated the number of steps of a driving motor (not illustrated).

In the state illustrated in FIG. 7A, the light receiving element S0 is shielded by the reference plate 16*a*; the light receiving element S1 is in the light receiving state, and the light receiving elements S2 and S3 are shielded by the sheet P. In FIG. 7B, the light receiving element S0 is in the light receiving state, and the light receiving elements S1 through S3 are shielded by the sheet P.

In FIG. 8, the signals are plotted starting from a time at which the sheet has not reached the side edge detection sensor unit 40; until the sheet leading edge reaches the side edge detection unit 40, the second through fourth light receiving elements S1 through S3 output High signals indicating the light receiving state. In this case, through the reciprocating movement in the width direction of the two-sided unit 20, the first light receiving element S0 has passed the side edge of the reference plate 16*a* many times, so that it outputs High-Low periodic signals caused by repetitiveness of shielding and light receiving.

In the present exemplary embodiment, the control unit 101 can recognize the side edge of the reference plate 16*a*, in other words, the 0-reference, from the rising edge from Low to High of the output signal from the first light receiving element S0. As illustrated in FIGS. 7A and 7B, even when it slides to the right-hand limit in FIGS. 7A and 7B, the light receiving sensor S0 does not get ahead of the reference plate 16*a* to receive light. Thus, the rising edge signal indicating the rise from shielding to light receiving (from Low to High) indicates that the first light receiving element S0 has slid from the right to the left to detect the side edge of the reference plate 16*a*.

In FIG. 8, the horizontal axis indicates the sheet leading edge arrival time, showing the state in which the sheet leading edge has reached the side edge detection sensor unit 40. At this time, as illustrated in FIG. 7A, the third and fourth light receiving elements S2 and S3 are shielded by the sheet P, and the output signals are changed to Low signals, whereas the second light receiving element S1 is not shielded by the sheet P, so that it remains a High signal indicating the light receiving state. As a result, the sheet conveyed can be restricted to a sheet size not smaller than the S4 size allowing detection of at least the fourth light receiving element S3, in other words, the S1 or S2 sheet size.

When the sensor holder 43 slides in the state of FIG. 7A to the left, which is one direction, the output signal of the second light receiving element S1 is changed from High to Low, and, by detecting this falling edge of the signal, the control unit 101 determines that the sheet size is S1. In this way, by detecting signal changes in the light receiving elements S1 through S3, it is possible to detect the sheet size. Further, the control unit 101 calculates (computes) the sheet side edge position from the time T1 from the Low-High rising edge signal of the first light receiving element to the High-Low falling edge signal of the light receiving element S1, and the motor step number C1 during the time T1.

The sliding distance of the light receiving elements S0 through S3 according to the motor step number is previously computed from the configuration of the cam 42, and, by counting the step number, it is possible to calculate the sliding amount (distance) of the light receiving elements S0 through S3. Thus, the sheet side edge position (the distance D to the sheet side edge position when the reference plate is regarded as 0) can be calculated from the following equation:

$$D=D1+K1 \quad \text{(equation 1)}$$

Where K1 is a value calculated from the sliding distance of the light receiving elements S0 through S3 according to the motor step number previously calculated, and from the motor step number C1 actually measured. D1 is the distance from the light receiving element S0 to the light receiving element S1 illustrated in FIGS. 7A and 7B. When the sheet side edge position detection is conducted by the light receiving elements S2 and S3, the calculation is possible by replacing D1 in equation 1 by D2 and D3.

Figure 9A:
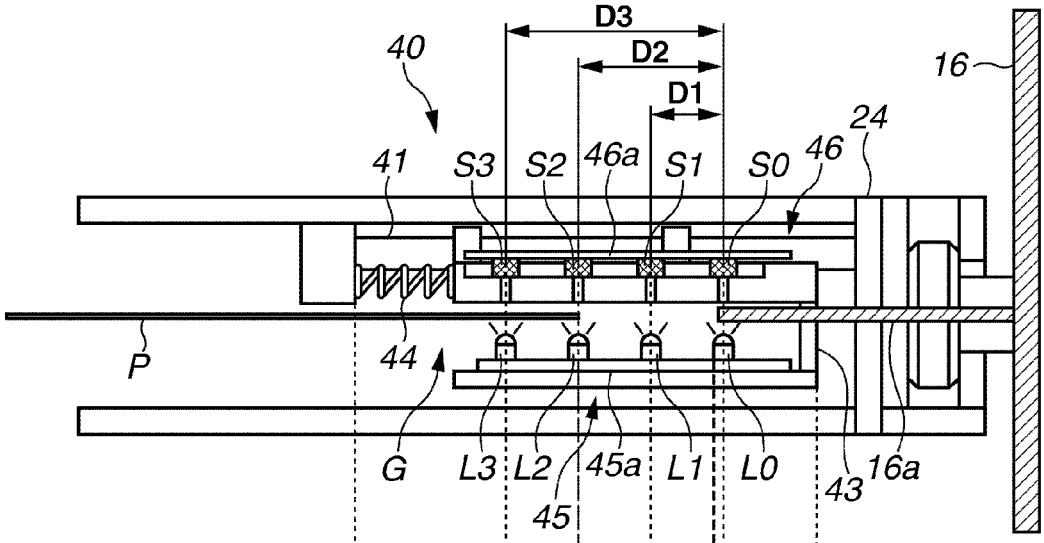
FIGS. 9A and 9B illustrate a sheet side edge detecting operation of the side edge detection sensor unit for a sheet of another size.
Figure 9B:
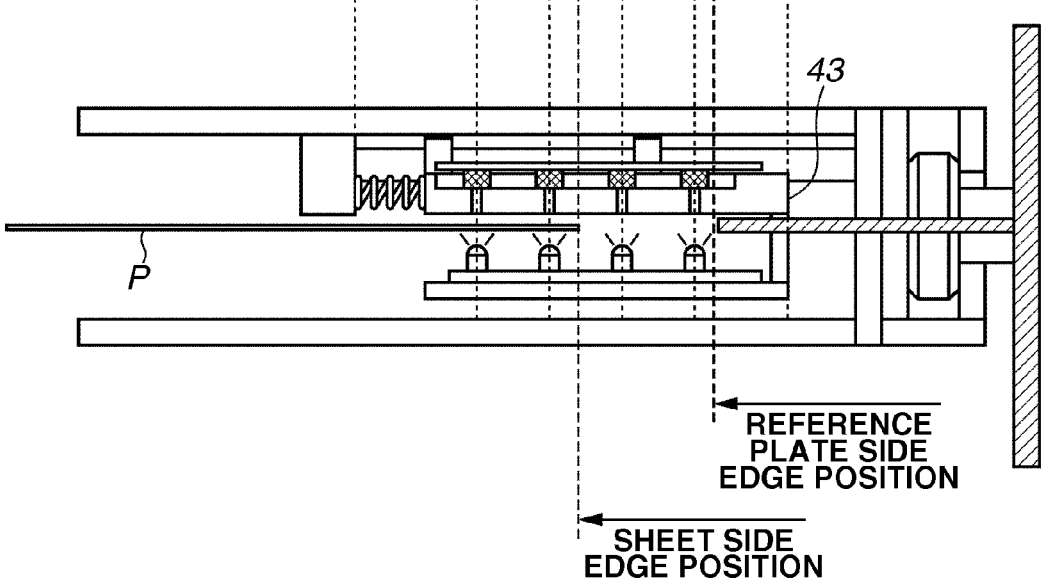
Figure 10:
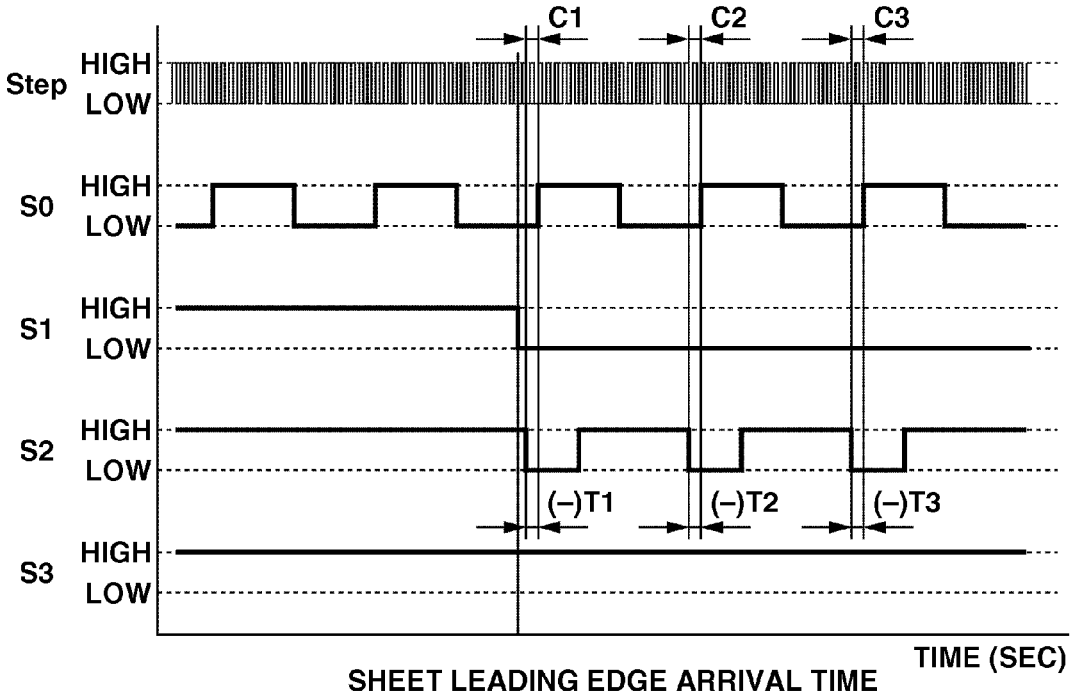
FIG. 10 is a chart illustrating output signals of the side edge detection sensor unit for a sheet of another size.

FIGS. 9A and 9B illustrate a state in which a sheet of a different size is conveyed by the same side edge detection sensor unit 40. FIG. 9A illustrates a state in which the sensor holder 43 has moved to the left, which is one direction in FIGS. 9A and 9B, with the sheet side edge being detected by the third light receiving element S2. At this time, the first light receiving element S0 is shielded by the reference plate 16*a*. FIG. 9B illustrates a state in which the sliding movement is further made to the left than in FIG. 9A, with the first light receiving element S0 having passed the side edge of the reference plate 16*a*. At this time, unlike the state of FIG. 8, before the Low-High rising edge signal of the first light receiving element S0 is detected as illustrated in FIG. 10, the High-Low falling edge signal of the third light receiving element S2 is detected. In this case, the sheet side edge position D can be calculated from the following equation:

$$D=D2-K2 \quad \text{(equation 2)}$$

Specifically, the sheet side end position D can be calculated by subtracting the distance K2 calculated from the motor step number from the inter-light-receiving element distance D2. And, based on the sheet side edge position thus calculated, the image writing position is corrected by an image writing control unit (not illustrated), whereby an optimized image can be formed on the sheet having passed the side edge detection sensor unit 40.

As described above, in the present exemplary embodiment, a plurality of light receiving elements S0 through S3 are arranged on the same substrate 46*a* at positions where it is possible to detect the reference plate 16*a* and the side edge positions of sheets of different lengths in the width direction, thus reading the sheet side edge position and the position of the reference plate 16*a*. And, owing to this construction, it is possible to detect the sheet side edge position in a short time. Further, by controlling the dimension between the light receiving elements of the plurality of light receiving elements S0 through S3 on the substrate 46*a*, the precision with which the sheet side edge position is detected is enhanced, and the image forming position on the sheet can be optimized.

In the present exemplary embodiment, in the calculation of the sheet side edge position, it is possible not only to utilize the initial detection value (T1) in FIGS. 8 and 10 but also to detect the values T2 and T3 repeatedly, thus, it is also possible to utilize the average value thereof. Further, in the sheet side edge position detection mechanism of the present exemplary embodiment, it is possible to repeatedly detect the sheet side edge position during sheet conveyance, so that the mechanism is also applicable to skew feed amount calculation and staying sheet detection, then it can be used as a jam detection sensor.

Figure 11A:
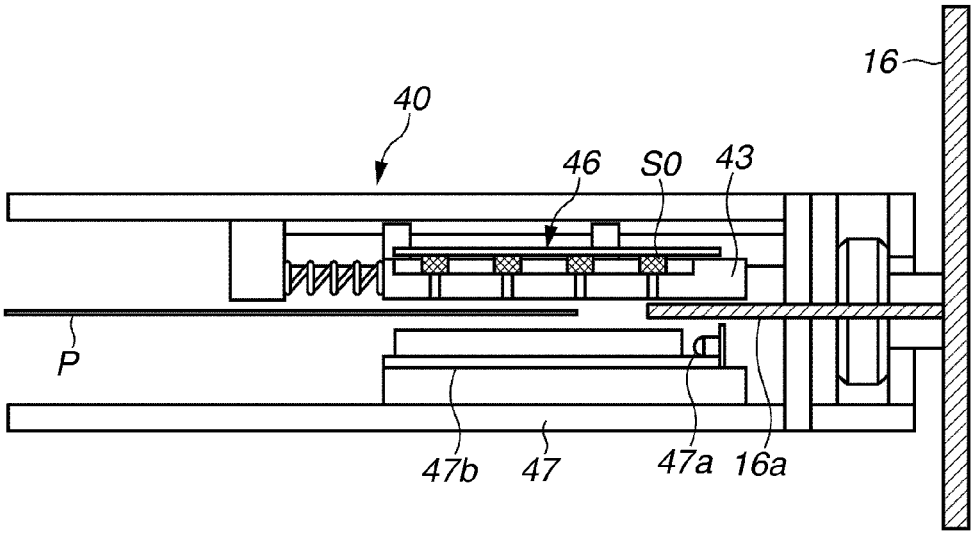
FIGS. 11A and 11B illustrate another construction of the side end detection sensor unit.
Figure 11B:
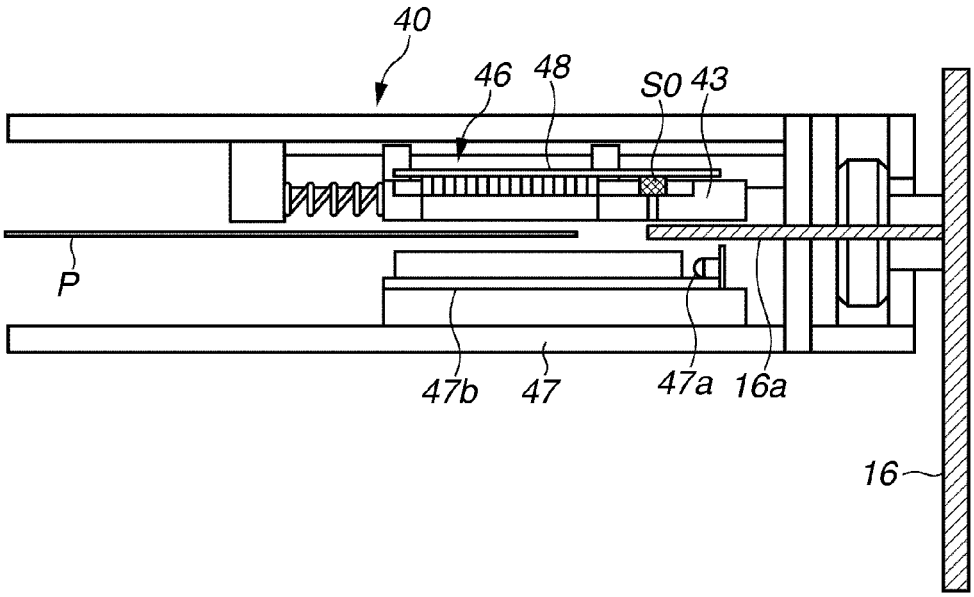

FIGS. 11A and 11B are sectional views illustrating another construction of the present exemplary embodiment; in FIG. 11A, a light emitting unit equipped with an LED 47*a* and a light guide 47*b* are fixed in position, with solely a light receiving unit 46 being slidable. In the light receiving unit 46 of FIG. 11B, a line sensor 48 arranged for the detection of the sheet side edge position and the light receiving element S0 for reading the reference plate 16*a* are separately provided on the same substrate, with solely the light receiving unit 46 being slidable. And, in this construction also, it is possible to detect the side edge position of the reference plate 16*a* and the sheet side edge position in a short time by a plurality of light receiving elements arranged on the same substrate.

Figure 12A:
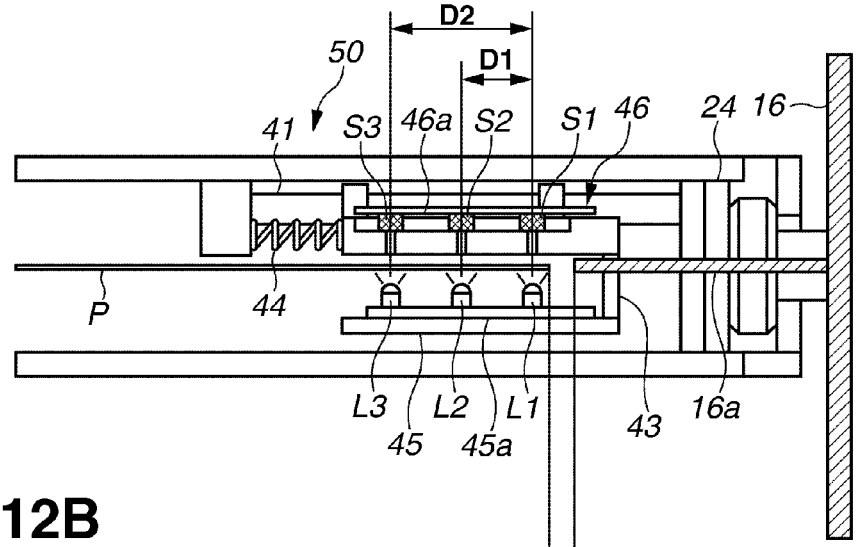
FIGS. 12A and 12B illustrate a two-sided unit constituting a sheet conveyance apparatus according to a third exemplary embodiment of the present invention.
Figure 12B:
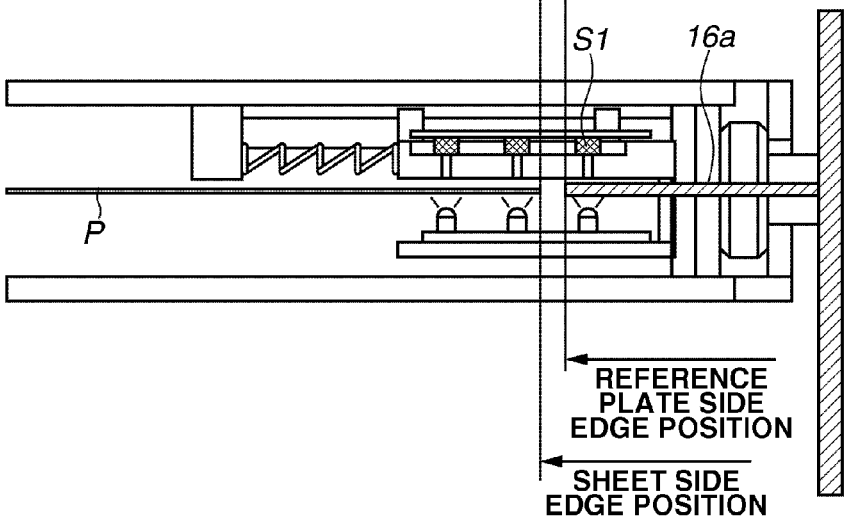

Next, the third exemplary embodiment of the present invention will be described with reference to the drawings. FIGS. 12A and 12B are diagrams illustrating the construction of a two-sided unit constituting a sheet conveyance apparatus according to the present exemplary embodiment. In FIGS. 12A and 12B, the same reference numerals as those in FIGS. 7A and 7B denote the components that are the same as or equivalent to those of FIGS. 7A and 7B.

In FIGS. 12A and 12B, numeral 50 denotes a side edge detection sensor unit; in this side edge detection sensor unit 50, the light receiving element S1 nearest to the reference plate 16*a* executes both the sheet side edge position detection of the sheet of the maximum size and the side edge detection of the reference plate 16*a*. In other words, the light receiving element S1 also serves as the light receiving element for detecting the reference plate 16*a*.

Figure 13:
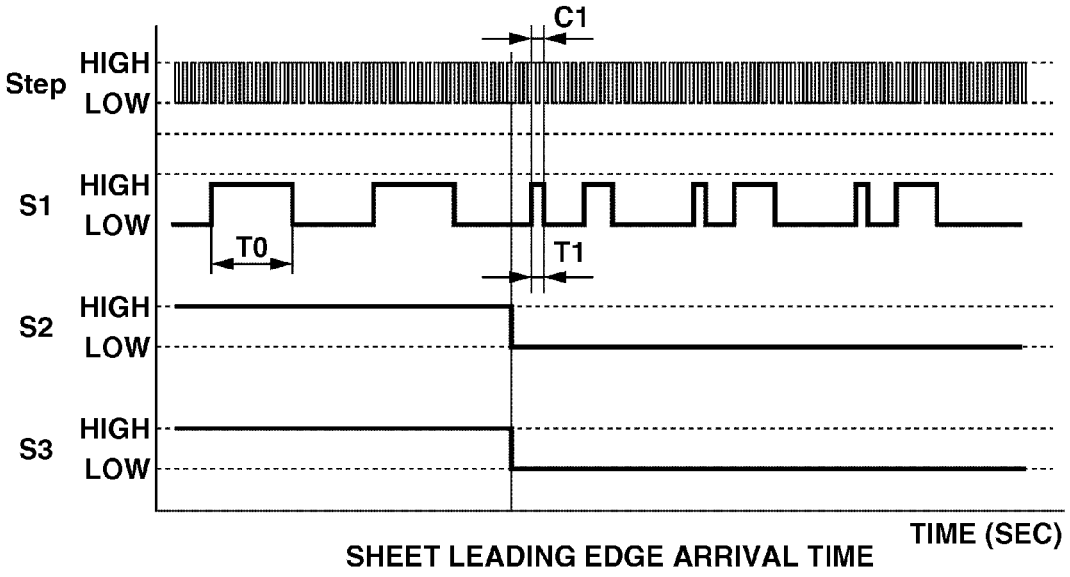
FIG. 13 illustrates an side edge detecting operation of a side edge detection sensor unit provided in the two-sided unit.

Here, FIGS. 12A and 12B illustrate a state in which the side edge detection sensor unit 50 makes a sliding motion, and FIG. 13 illustrates the output signals of the light receiving elements. As illustrated in FIG. 13, until the sheet leading edge reaches the side edge detection sensor unit 50, the light receiving elements S2 and S3 output the light receiving state (High). The light receiving element S1 repeatedly pass the side edge of the reference plate 16*a*, so that it outputs signal of repetition of High and Low.

Next, the sheet side end position detecting operation by the side end detection sensor unit 50, constructed as described above, will be described. First, by the time the sheet leading edge reaches the side edge detection sensor 50, the time T0 in FIG. 13 is measured from the signal of repetition of High and Low. The time T0 corresponds to the period of time when the light receiving element S1 changes to the light receiving state from the shielded state and then changes to the shielded state again. It signifies the period of time when the light receiving element S1 has passed the side edge of the reference plate 16*a* while moving to the left, and return to the side edge of the reference plate 16*a* after a reciprocating movement.

Next, when the sheet leading edge reaches the side edge detection sensor unit 50, the cycle of the time T0 gets out of order, and a Low-High rising edge signal appears at a time interval shorter than the time T0. Using this point in time of change as a trigger, the sheet side edge position detection is executed. Specifically, the time T1 in FIG. 13 is measured, and the sheet side edge position is calculated from the motor step number during that period.

In this case, the sheet side end position detection and the side edge position detection of the reference plate 16*a* are executed by the single light receiving element S0, so that D1 in equation 1 described above is 0, and only the K factor calculated from the motor step number remains. In the case where the sheet side edge detection is effected by the other light receiving elements S2 and S3, the procedures involved are the same as those of the second exemplary embodiment described above.

Here, in the construction of the present exemplary embodiment also, a plurality of light receiving elements S1 through S3 are arranged on the same substrate to be capable of detecting the side edge positions of sheets of different lengths in the width direction, and, at the same time, the side edge position of the sheet and the reference position (the reference plate 16*a*) of the apparatus main body are read. And, owing to this construction, it is possible to detect the side edge position of a sheet in a short time. Further, by controlling the dimension between the light receiving elements of the plurality of light receiving elements S1 through S3 on the substrate 46*a*, it is possible to detect the sheet side edge position with high precision, whereby the image forming position on the sheet can be optimized.

Figure 14A:
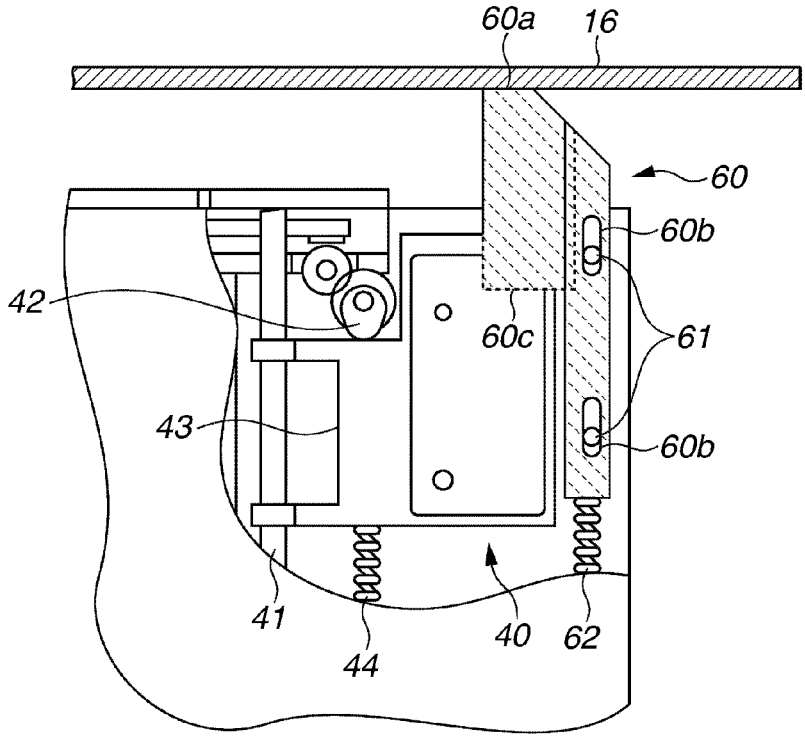
FIGS. 14A and 14B illustrate the construction of a side edge detection sensor unit provided in a two-sided unit constituting a sheet conveyance apparatus according to a fourth exemplary embodiment of the present invention.
Figure 14B:
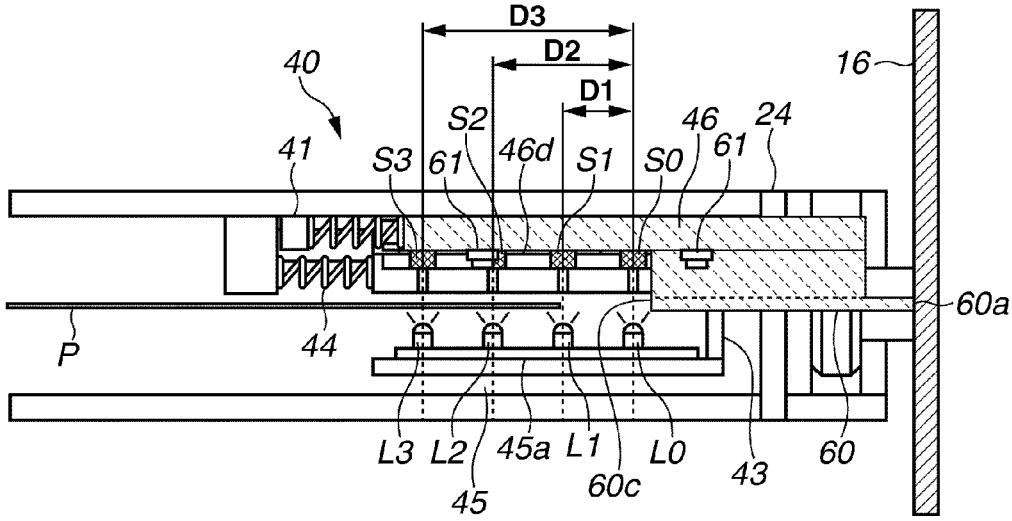

Next, the fourth exemplary embodiment of the present invention will be described with reference to the drawings. FIGS. 14A and 14B are diagrams illustrating the construction of a two-sided unit constituting a sheet conveyance apparatus according to the present exemplary embodiment. In FIGS. 12A and 12B, the same reference numerals as those in FIGS. 7A and 7B denote the components that are the same as or equivalent to those of FIGS. 7A and 7B.

In FIGS. 14A and 14B, numeral 60 denotes a reference plate member corresponding to the reference plate; the reference plate member 60 is supported on the two-sided unit 20 to be slidable in the width direction by two guide pins 61 provided on the two-sided unit 20 and two guide holes 60*b* provided in the reference plate member 60. Further, the reference plate member 60 is biased toward the rear side plate 16 by a spring 62; in the state in which the two-sided unit 20 is attached to the apparatus main body 1, an abutment portion 60*a* of the reference member 60 abuts on the rear side plate 16.

Numeral 60*c* denotes a sheet side edge position reference edge of the reference plate member 60; this sheet side edge position reference edge 60*c* serves in the same way as the side edge of the reference plate of the first through third exemplary embodiments described above, and is arranged between the light emitting unit 45 and the light receiving unit 46. Specifically, the light emitting unit 45 and the light receiving unit 46 detect the sheet side edge position reference edge 60*c* to detect the side edge of the reference plate member 60. The sliding motion of the light emitting unit 45, the light receiving unit 46, and the sensor holder 43 and the side edge position detecting method are the same as those of the second exemplary embodiment described above, and a description will be omitted.

In this way, in the present exemplary embodiment, the reference plate member 60 having the sheet side edge position reference edge 60*c* is supported in the two-sided unit 20 to be sliable in the sheet width direction, and is caused to directly abut on the rear side plate 16. Owing to this construction, it is possible to enhance the positional precision of the sheet side edge position reference edge 60*c*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-150247 filed Jun. 30, 2010, which is hereby incorporated by reference herein in its entirety.

What is claimed is:

1. An image forming apparatus comprising:

an image forming apparatus main body having an image forming unit configured to form an image on a sheet;

a sheet conveyance apparatus provided to be detachable with respect to the image forming apparatus main body and configured to convey the sheet to the image forming unit, wherein the sheet conveyance apparatus includes:

a sheet conveyance path through which the sheet passes, and a detection unit including a light emitting unit and a light receiving unit, opposed to the light emitting unit across the sheet conveyance path positioned therebetween, wherein the detection unit is configured to detect a position of a reference portion provided in relation to the image forming apparatus main body and to detect an edge position of the conveyed sheet in a width direction of the sheet orthogonal to a sheet conveyance direction, and wherein the light receiving unit is composed of a plurality of light receiving elements configured to receive light from the light emitting unit and arranged in the width direction on a same substrate; and a control unit configured to determine a position of the sheet based on detections of the position of the reference portion and the edge position of the conveyed sheet by the detection unit.

2. The image forming apparatus according to claim 1, wherein the control unit is configured to control a position of the image that the image forming unit forms on the sheet according to the edge position of the sheet detected by the detection unit with respect to a position of the reference portion detected by the detection unit.

3. The image forming apparatus according to claim 1, wherein the plurality of light receiving elements are arranged in series at positions on the same substrate where they face the reference portion and the sheet passing through the sheet conveyance path, and wherein the reference portion and the edge position in the width direction of the sheet are detected based on a signal from that light receiving element, of the plurality of light receiving elements arranged in series, which received the light from the light emitting unit.

4. The image forming apparatus according to claim 1, wherein the image forming apparatus is configured to convey sheets of different lengths in the width direction, and wherein one light receiving element of the plurality of light receiving elements is arranged corresponding to the reference portion and other light receiving elements of the plurality of light receiving elements are arranged corresponding to the edge position of sheets of different lengths in the width direction, and wherein the substrate on which the plurality of light receiving elements are arranged is provided to be capable of moving in the width direction for detecting the edge position of the conveyed sheet in the width direction of the sheet.

5. The image forming apparatus according to claim 4, wherein the position of reference portion is detected by the light receiving element of the plurality of light receiving elements that is nearest to the reference portion.

6. The image forming apparatus according to claim 1, wherein the reference portion is provided on the image forming apparatus main body and is configured to enter the sheet conveyance path in a case where the sheet conveyance apparatus is attached to the image forming apparatus main body.

7. The image forming apparatus according to claim 1, further comprising: a positioning portion provided on the sheet conveyance apparatus and configured to perform positioning on the sheet conveyance apparatus in a case where the sheet conveyance apparatus is attached to the image forming apparatus main body, with the reference portion being provided on the positioning portion.

8. The image forming apparatus according to claim 1, wherein the reference portion is provided on the sheet conveyance apparatus to be movable in the width direction and is configured to move while abutting on the image forming apparatus main body in a case where the sheet conveyance apparatus is attached to the image forming apparatus main body.

9. The image forming apparatus according to claim 1, wherein the sheet conveyance apparatus is configured to reverse a sheet whose first surface has undergone image formation at the image forming unit and to convey the sheet to the image forming unit again.

* * * * *